US010006593B2

(12) United States Patent
Osada et al.

(10) Patent No.: US 10,006,593 B2
(45) Date of Patent: Jun. 26, 2018

(54) LAMP SYSTEM

(71) Applicants: Toshiba Lighting & Technology Corporation, Yokosuka-shi, Kanagawa (JP); Panasonic Corporation, Kadoma-shi, Osaka (JP)

(72) Inventors: Takeshi Osada, Yokosuka (JP); Masahiko Kamata, Yokosuka (JP); Kiyoshi Takahashi, Kyoto (JP); Shougo Takahashi, Kyoto (JP); Satoshi Fukano, Osaka (JP)

(73) Assignees: TOSHIBA LIGHTING & TECHNOLOGY CORPORATION, Kanagawa (JP); PANASONIC CORPORATION, Kadoma-shi, Osaka (JP)

( * ) Notice: Subject to any disclaimer, the term of this patent is extended or adjusted under 35 U.S.C. 154(b) by 0 days. days.

(21) Appl. No.: 14/844,105

(22) PCT Filed: Dec. 24, 2013

(86) PCT No.: PCT/JP2013/084432

§ 371 (c)(1),
(2) Date: Nov. 9, 2016

(87) PCT Pub. No.: WO2014/136361

PCT Pub. Date: Sep. 12, 2014

(65) Prior Publication Data

US 2017/0241599 A1 Aug. 24, 2017

(30) Foreign Application Priority Data

Mar. 4, 2013 (JP) ..... 2013-042383

(51) Int. Cl.
*F21V 11/00* (2015.01)
*F21K 9/272* (2016.01)
(Continued)

(52) U.S. Cl.
CPC ..... *F21K 9/272* (2016.08); *F21K 9/278* (2016.08); *F21V 3/02* (2013.01); *F21V 17/10* (2013.01);
(Continued)

(58) Field of Classification Search
CPC ..... F21K 9/272; F21V 17/10; F21V 3/02
(Continued)

(56) References Cited

FOREIGN PATENT DOCUMENTS

| | | |
|---|---|---|
| CN | 101329039 A | 12/2008 |
| CN | 201593769 U | 9/2010 |
| JP | 09-102211 | 4/1997 |
| JP | H09102211 | 4/1997 |

(Continued)

OTHER PUBLICATIONS

Japanese Office Action/Notification of Reasons for Refusal, JP Patent Application No. 2013-042383, dated Aug. 17, 2016, 9 pages.

(Continued)

*Primary Examiner* — William Carter
(74) *Attorney, Agent, or Firm* — Ulmer & Berne LLP

(57) ABSTRACT

A lamp system (10) includes a straight tube type lamp (13) and a socket (14). The straight tube type lamp (13) includes a straight tube type cover (20) containing a light-emitting element, and caps (23) arranged at both ends of the cover (20). A pair of lamp pins (30) whose tips respectively protrude in directions intersecting a lamp longitudinal direction are protrudingly provided on end faces of the caps (23) at both the ends. The socket (14) includes a socket body (41), a rotor (42) which is arranged in the socket body (41) and on which the pair of lamp pins (30) of the straight tube type lamp (13) are mounted, and a pair of terminals to which the pair of lamp pins (30) mounted on the rotor (42) are connected. At least the rotor (42) can move in the lamp longitudinal direction.

6 Claims, 11 Drawing Sheets

(51) Int. Cl.

| | |
|---|---|
| ***F21V 3/02*** | (2006.01) |
| ***F21K 9/278*** | (2016.01) |
| ***F21V 17/10*** | (2006.01) |
| *F21Y 115/10* | (2016.01) |
| *F21Y 103/10* | (2016.01) |

(52) U.S. Cl.
CPC ..... *F21Y 2103/10* (2016.08); *F21Y 2115/10* (2016.08)

(58) Field of Classification Search
USPC ..... 362/368, 217.1–217.17
See application file for complete search history.

(56) References Cited

FOREIGN PATENT DOCUMENTS

| | | | | | |
|---|---|---|---|---|---|
| JP | 10-247415 | | | 9/1998 | |
| JP | 2009289456 | A | | 12/2009 | |
| JP | 2012-014831 | A | | 1/2012 | |
| JP | 2012014831 | | | 1/2012 | |
| JP | 2012119135 | A | * | 6/2012 | ..... F21V 23/06 |
| JP | 2012119135 | A | | 6/2012 | |
| JP | 2012-142198 | A | | 7/2012 | |
| JP | WO2014/136361 | A1 | | 9/2014 | |

OTHER PUBLICATIONS

State Intellectual Property Office (SIPO), Office Action for Chinese Patent Application No. 201380072567.3, dated Aug. 30, 2017, 6 pages.

* cited by examiner

LAMP SYSTEM

TECHNICAL FIELD

The present invention relates to a lamp system using a straight tube type lamp and a socket.

BACKGROUND ART

Hitherto, there is a lamp system using a straight tube type lamp based on general Japan Lighting Manufacturers Association standard JEL801 "straight tube type LED lamp system with L-shaped cap" and a socket for mounting the straight tube type lamp.

As disclosed in, for example, PTL 1, in the straight tube type lamp, caps are arranged at both ends in a lamp longitudinal direction, a pair of L-shaped lamp pins whose tips protrude in outside directions intersecting the lamp longitudinal direction are protrudingly provided on an end face of the cap at one end, and one non-feeding side pin is protrudingly provided on an end face of the cap at the other end.

On the other hand, the straight tube type lamp mounted on a corresponding socket can expand and contract in the lamp longitudinal direction according to the temperature. Thus, in the straight tube type lamp of PTL 1, the non-feeding side pin can move in the lamp longitudinal direction with respective to a terminal to support the non-feeding side pin, and even when the lamp pin at the one end side is mounted on the socket, the non-feeding side pin at the other end side moves in the lamp longitudinal direction and can absorb the expansion and contraction of the lamp.

CITATION LIST

Patent Literature

PTL 1: Japanese Laid-Open Patent Publication No. 2012-142198

SUMMARY OF INVENTION

Technical Problem

For example, when a straight tube type lamp different in electrical characteristic from the straight tube type lamp based on JEL801 is provided, if the straight tube type lamp different in electrical characteristic can be erroneously mounted on a socket based on JEL801, inconsistency in electrical characteristic occurs between the straight tube type lamp side and an equipment side using the socket. Thus, compatibility is required to be eliminated by using a cap and a socket different from the cap and the socket of the straight tube type lamp based on JEL801. Besides, consideration is preferably given to that the straight tube type lamp expands and contracts in the lamp longitudinal direction according to the temperature.

The problem to be solved by the invention is to provide a lamp system which can deal with expansion and contraction of a straight tube type lamp in a lamp longitudinal direction.

Solution to Problem

A lamp system of the invention includes a straight tube type lamp and a socket. The straight tube type lamp includes a straight tube type cover containing a light-emitting element, and caps arranged at both ends of the cover. A pair of lamp pins whose tips respectively protrude in directions intersecting a lamp longitudinal direction are protrudingly provided on end faces of the caps at both the ends. The socket includes a socket body, a mount part which is arranged in the socket body and on which the pair of lamp pins of the straight tube type lamp are mounted, and a pair of terminals to which the pair of lamp pins mounted on the mount part are connected. At least the mount part can move in the lamp longitudinal direction.

Advantageous Effects of Invention

According to the invention, even in the straight tube type lamp including the pair of lamp pins whose tips respectively protrude on end faces of the caps at both the ends in the directions intersecting the lamp longitudinal direction, at least the mount part of the socket can move in the lamp longitudinal direction, so that expansion and contraction of the straight tube type lamp in the lamp longitudinal direction can be expected to be dealt with.

DESCRIPTION OF EMBODIMENTS

Hereinafter, a first embodiment will be described with reference to FIG. 1 to FIG. 6.

Figure 5:
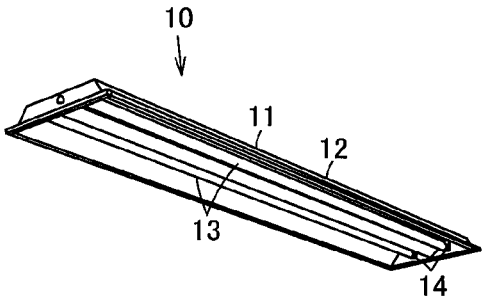
FIG. 5 is a perspective view of a luminaire of the lamp system.

FIG. 5 is a perspective view of a luminaire 11 of a lamp system (LED lamp system) 10. The luminaire 11 is, for example, an embedded luminaire for two lamps.

The lamp system 10 includes a long equipment body 12, a straight tube type lamp 13 arranged in the equipment body 12, and sockets 14 and 15 which are oppositely arranged at both ends of the equipment body 12 and on which both ends of the straight tube type lamp 13 are mounted.

Figure 2:
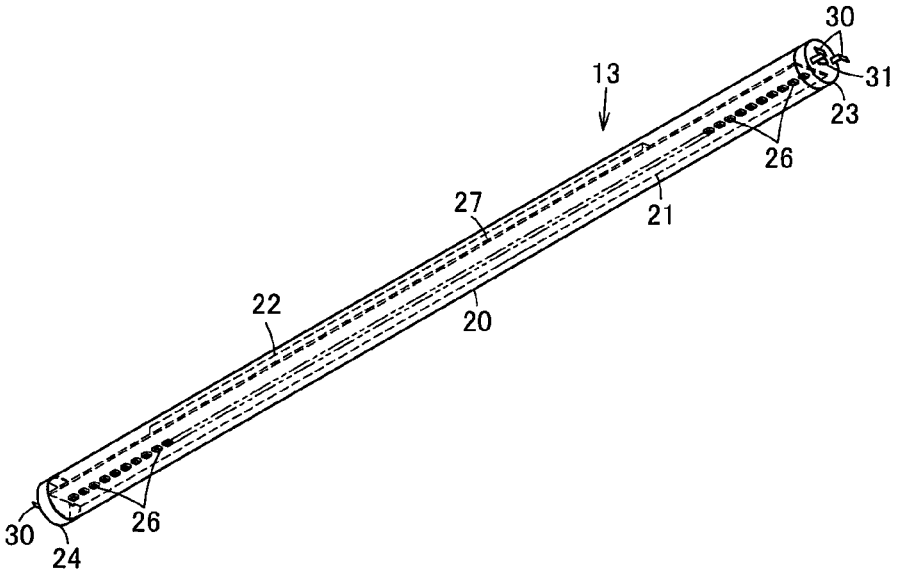
FIG. 2 is a perspective view of the straight tube type lamp.

As shown in FIG. 2, the straight tube type lamp 13 includes a cylindrical cover 20 including at least a transparent part, a light-emitting module 21 and a power circuit 22 contained in the cover 20, and caps 23 and 24 respectively disposed at both ends of the cover 20.

Incidentally, the straight tube type lamp 13 includes a base (not shown) made of, for example, aluminum and formed along a lamp longitudinal direction. The light-emitting module 21 and the power circuit 22 are mounted on the base, the cover 20 is attached thereto, and the caps 23 and 24 are attached to both ends of the base.

The light-emitting module 21 includes plural light-emitting elements 26 as semiconductor light-emitting elements, such as LED elements or EL elements, and a board 27 on which the plural light-emitting elements 26 are mounted. When the light-emitting elements 26 are LED elements, a SMD (Surface Mount Device) package of surface mount type is mounted on the board 27, or a COB (Chip On Board) module in which plural LED elements are mounted on the board 27 is used.

The power circuit 22 inputs AC power from the cap 23 at one end side, converts into specified DC power for turning on the light-emitting elements 26, and supplies to the light-emitting module 21.

Figure 1:
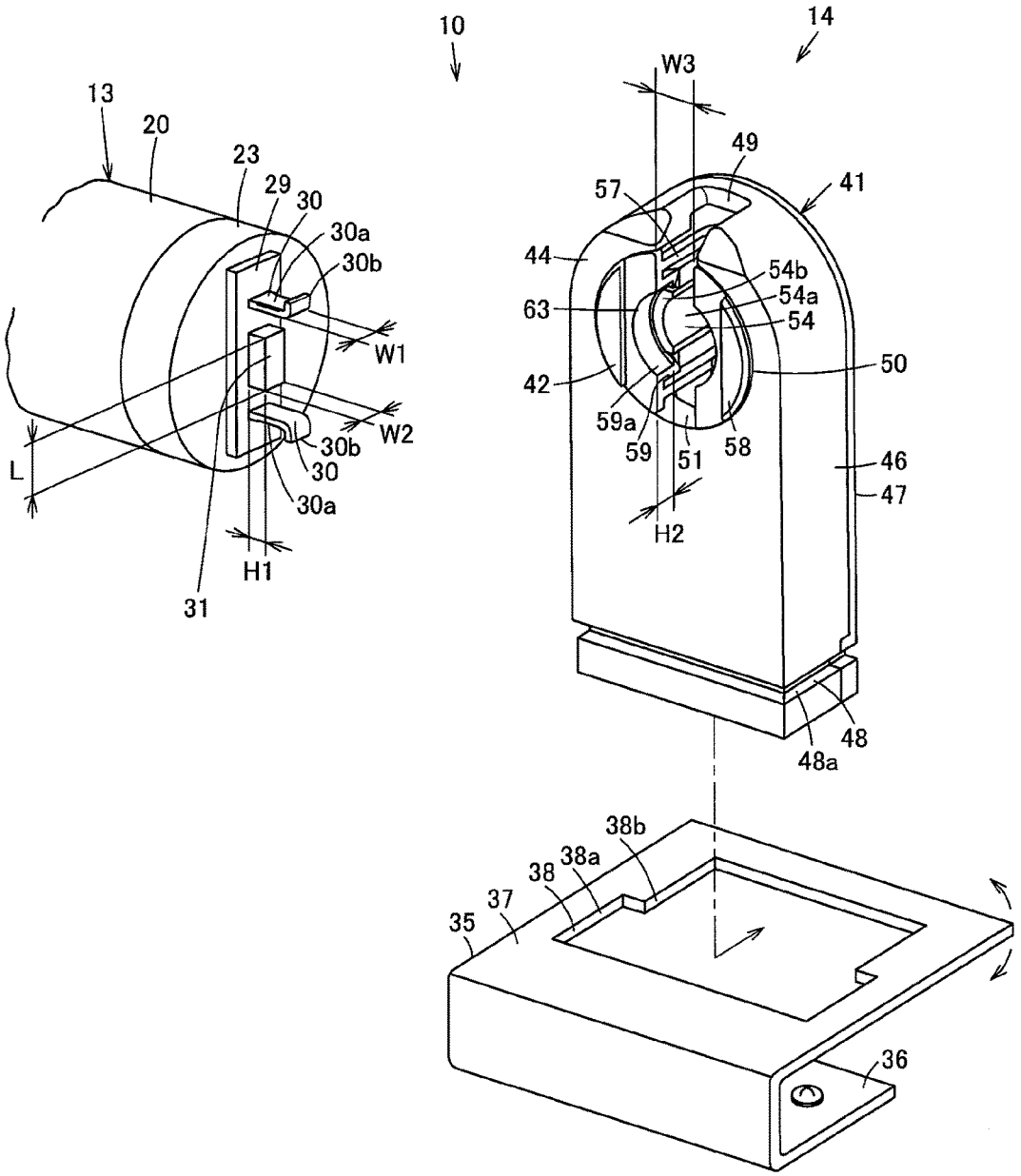
FIG. 1 is a perspective view of a straight tube type lamp and a socket of a lamp system showing a first embodiment.

The caps 23 and 24 at both the ends have a common shape and structure. As shown in FIG. 1, a projection part 29 passing through a tube axis of the straight tube type lamp 13 and protruding along a radial direction is formed on end faces of the caps 23 and 24 (although FIG. 1 shows only the cap 23, the cap 24 has the same shape) at both the ends. A pair of lamp pins 30 protrude from the projection part 29 symmetrically with respect to the tube axis. The pair of lamp pins 30 are formed of flat metal plates having square sections, and are formed to be bent into L shapes having leg parts 30*a* protruding along the lamp longitudinal direction and bent parts 30*b* protruding from tips of the leg parts 30*a* in outside directions intersecting the lamp longitudinal direction so as to separate mutually from the other leg parts 30*a*. The caps 23 and 24 including the pair of lamp pins 30 are based on, for example, general Japan Lighting Manufacturers Association standard JEL801 "straight tube type LED lamp system with L-shaped cap", and has no compatibility with a G13 cap.

A protrusion 31, which is not specified by JEL801, is protrudingly provided between the pair of lamp pins 30 at the end face of the cap 23, 24. The protrusion 31 is formed to have a rectangular parallelepiped shape long along the opposing direction of the pair of lamp pins 30. A length size L of the protrusion 31 between the pair of lamp pins 30 is longer than a width size W1 of the lamp pin 30, and a width size W2 is wider than the width size W1 of the lamp pin 30. A protrusion size H1 of the protrusion 31 from the end face (projection part 29) of the cap 23, 24 is lower than the height of the lamp pin 30, and is preferably about ⅓ to ⅔ of the height of the lamp pin 30.

Incidentally, in the straight tube type lamp 13, the pair of lamp pins 30 of the cap 23, 24 at both ends are protrudingly provided in parallel to each other, and a surface parallel to a direction in which the pair of lamp pins 30 are arranged and the board 27 of the module 21 are provided to be parallel to each other.

Figure 3:
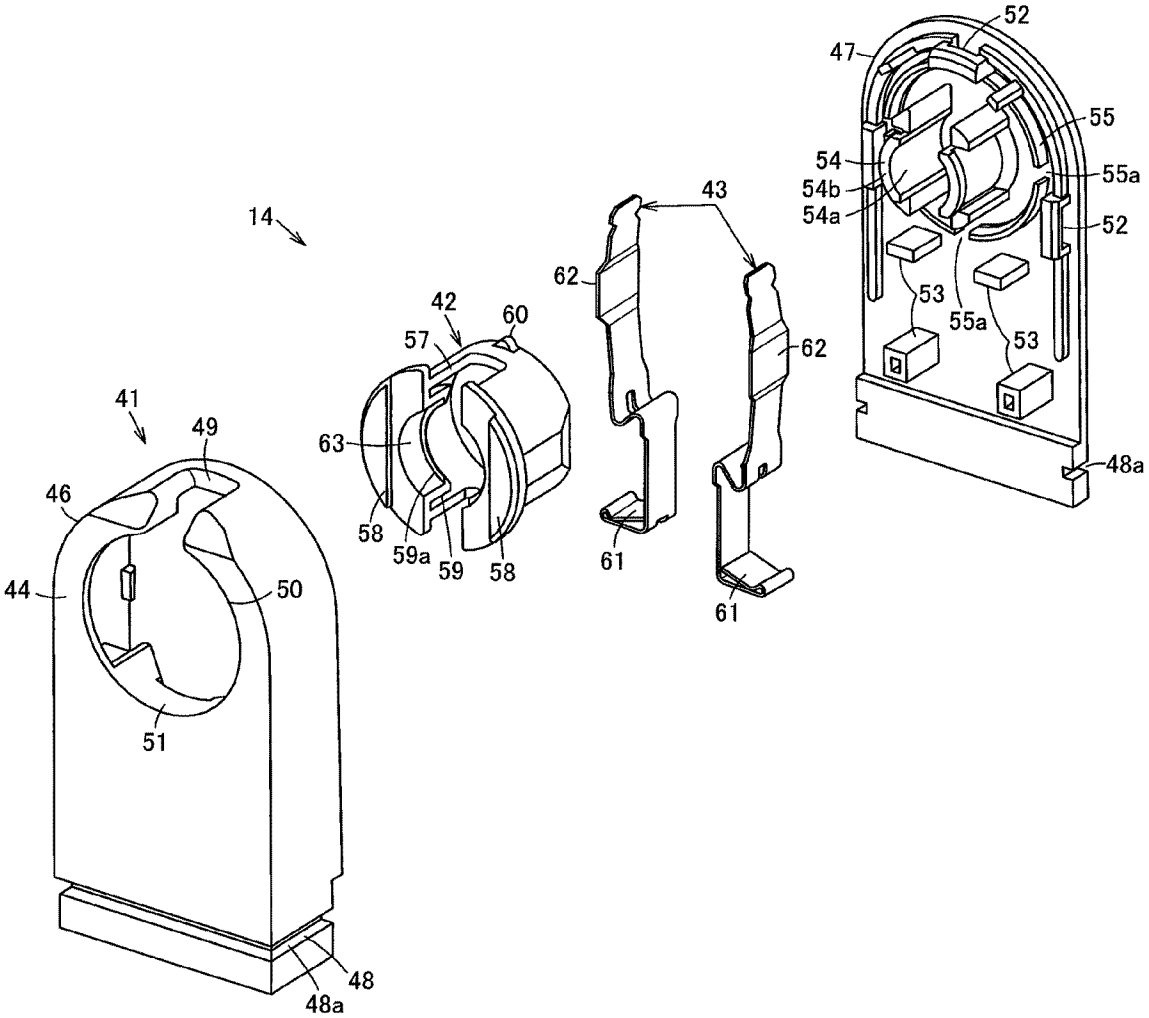
FIG. 3 is a perspective view of a disassembled state of the socket.

Besides, as shown in FIG. 1 and FIG. 3, in the sockets 14 and 15 (although FIG. 1 and FIG. 3 show only the socket 14, the socket 15 has the same shape), a rotation mounting type is used in which mounting is performed such that after the pair of lamp pins 30 of the straight tube type lamp 13 are inserted from the outside faces of the sockets 14 and 15, the lamp pins are rotated by 90° around the tube axis of the straight tube type lamp 13.

The socket 14, 15 is attached to a socket stand 35 installed on the equipment body 12. The socket stand 35 is formed to have a substantially C-shaped section as a whole, in which an almost L-shaped pedestal part 37 is bent from a fixed part 36 fixed to the equipment body 12. An attachment port 38 to which the socket 14, 15 is attached is formed in the pedestal part 37. The attachment port 38 is provided with an insertion port 38*a* through which the socket 14, 15 can pass, and an attachment port 38*b* whose width is narrower than the insertion port 38*a*.

The socket 14, 15 includes a socket body 41, a rotor 42 as a mount part arranged in the socket body 41, and a pair of terminals 43. Incidentally, hereinafter, with respect to the socket 14, 15, a side where the socket is attached to the equipment body 12 is a base end, and the opposite side is a tip end. A face opposite to the end face of the straight tube type lamp 13 at the time of mounting is a bracket face 44 as a front face, the opposite side is a back face, and a portion between the front face and the back face is a side face.

The socket body 41 is made of a synthetic resin material having insulation properties, and includes a case 46 having an opened back face, and a cover 47 attached to the back face of the case 46.

An equipment attachment part 48 to be attached to the socket stand 35 of the equipment body 12 is provided at the base end of the case 46. The equipment attachment part 48 includes grooves 48*a* provided at least at both sides of the case 46 along the front-back direction (lamp longitudinal direction), and the grooves 48*a* at both the sides are fitted in and attached to edge parts of the attachment port 38*b* at both sides. An insertion port 49 in which the pair of lamp pins 30 of the straight tube type lamp 13 can be inserted is formed on the tip face of the case 46. The insertion port 49 communicates with the bracket face 44 as the front face of the case 46, and a circular opening 50 is formed which allows rotation of the leg parts 30*a* of the pair of lamp pins 30 inserted from the insertion port 49 and is an arrangement part where the rotor 42 is rotatably arranged.

A pair of terminal holding parts to hold the pair of terminals 43 are formed in the case 46, and an electric wire insertion hole is formed in the base end face of the case 46.

In the case 46, a wall part 51 is vertically protrudingly formed from the front side to the back side at the opposite side to the tip insertion port 49 and at the edge part of the opening 50 opposing the insertion port 49. When the straight tube type lamp 13 is inserted in the sockets 14 and 15 in a proper state, the bent part 30*b* of the one lamp pin 30 first inserted from the insertion port 49 intrudes from the wall part 51 into the back side, the leg part 30*a* contacts the wall part 51, and the wall part 51 allows the straight tube type lamp 13 to be inserted to the specified insertion position with respect to the sockets 14 and 15. Besides, for example, when the straight tube type lamp 13 is inserted in the sockets 14 and 15 in a separate state, the tip of the bent part 30*b* of the one lamp pin 30 first inserted from the insertion port 49 contacts the wall part 51, and the wall part regulates that the straight tube type lamp 13 is inserted to the specified insertion position with respect to the sockets 14 and 15.

Besides, on the front face of the cover 47, plural locking parts 52 locked to the case 46 in a state where the back face of the case 46 is closed are formed, and plural holding protrusions 53 to position and hold the respective terminals 43 with respective to the case 46 are protrudingly provided. Further, on the front face of the cover 47, a pair of support parts 54 to rotatably support the rotor 42 are protrudingly provided at a concentric position to the opening 50 of the case 46, and a guide wall 55 is protrudingly provided along the peripheries of the support parts 54. A groove part 54*a* through which the lamp pin 30 can pass is formed between the pair of support parts 54, and pawl parts 54*b* to lock and to prevent slip-off of the rotatably supported rotor 42 are formed at the tips of the pair of support parts 54. Besides, a cutout 55*a* for giving moderation to the rotor 42 at a specified rotation position is formed every 90° on the guide wall 55. Besides, the front face of the support part 54 is arranged at a recessed position closer to the back side than the front face of the rotor 42. A depth size H2 thereof is larger than the protrusion size H1 of the protrusion 31, and is of such a size to prevent interference with the protrusion 31 of the straight tube type lamp 13 mounted on the sockets 14 and 15. Similarly to the case 46, grooves 48*a* of the equipment attachment part 48 are formed on both sides of the cover 47.

Besides, the rotor 42 is made of a synthetic resin having insulation properties and is formed into a cylindrical shape rotatably fitted to the periphery of the support part 54 of the cover 47. A groove part 57 to allow the lamp pin 30 to pass through is formed along the radius direction at a position closer to the front face of the rotor 42.

The front part of the rotor 42 is rotatably arranged in the opening 50 of the case 46, and a pair of guide protrusions 58 which protrude from the front face of the case 46 and to which the projection part 29 of the cap 23, 24 of the straight tube type lamp 13 is slide fitted are protrudingly formed on the front face of the rotor 42. Further, an arc shaped fitting part 59 rotatably fitted to the periphery of the support part 54 is formed on the front face of the rotor 42, and a step part 59*a* to which the pawl part 54*b* of the support part 54 is locked is formed on the fitting part 59. The back part of the rotor 42 is arranged between the support part 54 and the guide wall 55. A pair of positioning protrusions 60 are protrudingly formed on the back outer peripheral surface of the rotor 42 and at two places parallel to the groove direction of the groove part 57. The positioning protrusions 60 are engaged with the cutouts 55*a* of the guide wall 55 and give moderation to the rotation position of the rotor 42. A part of the rotor 42 is elastically deformed at the periphery of the positioning protrusion 60, so that the positioning protrusion 60 contacts the inner peripheral surface of the guide wall 55 and slides along the inner peripheral surface, and the rotation of the rotor 42 is allowed.

Besides, the pair of terminals 43 are formed of plate springs having conductivity, and are sandwiched and held between the case 46 and the cover 47. The terminal 43 is provided with an electric wire connection part 61 to which an electric wire inserted from an electric wire insertion hole of the socket body 41 is connected and a lamp pin connection part 62 connected to the lamp pin 30.

A width size W3 of the insertion port 49 of the socket 14, the groove part 57 of the rotor 42, and the groove part 54*a* of the support part 54 is wider than the width size W1 of the lamp pin 30 and the width size W2 of the protrusion 31, and is formed to enable insertion of the lamp pin 30 and the protrusion 31.

Further, with respect to the socket body 41, in a state where the equipment attachment part 48 is attached to the equipment body 12, the rotor 42 side as the tip side of the socket body 41 arranged at the position separated from the equipment attachment part 48 side can be moved in the lamp longitudinal direction by elastic deformation of the socket body 41 itself (further including an attachment member of the equipment body 12 side to which the socket body 41 is attached). Incidentally, in the state where the socket 14 is attached to the socket stand 35 of the equipment body 12, since the pedestal part 37 of the socket stand 35 is provided to be elastically deformed, a space to enable movement caused by the elastic deformation of the socket 14 is formed between the back face of the socket 14 and an endplate of the equipment body 12.

Besides, as shown in FIG. 1, the socket 14, 15 is provided with a recess 63 to enable insertion movement and rotation movement of the protrusion 31 caused by insertion and rotation of the straight tube type lamp 13 to be mounted on the socket 14, 15. The recess 63 is formed by sharing the insertion port 49 of the socket body 41 and the front region of the groove part 57 of the rotor 42, and is formed inside the fitting part 59 of the rotor 42 and in the region closer to the front side than the support part 54.

A width size W3 of a minimum width part of the recess 63 is equal to the width size W3 of the insertion port 49, the groove part 57 of the rotor 42 and the groove part 54*a* of the support part 54. Although the width size W3 is wider than the width size W2 of the protrusion 31, the size is such that a finger does not enter the inside of the socket body 41. Further, the depth size H2 of the recess 63 from the front face of the rotor 42 to the front face of the support part 54 is larger than the protrusion size H1 of the protrusion 31, and the protrusion 31 can be inserted and arranged in the recess 63.

As an example of the respective sizes, the protrusion size H1 of the protrusion 31 is 2 mm or more, and is preferably 3.5 (+0.2, −0) mm. The width size W2 is 5 mm at most, and the length size L is 7.5 (±0.2) mm. The width size W3 of the insertion port 49, the groove part 57 of the rotor 42, and the groove part 54*a* of the support part 54 is 5.2 mm at most, and the depth size H2 of the recess 63 is 3.5 mm.

Figure 4:
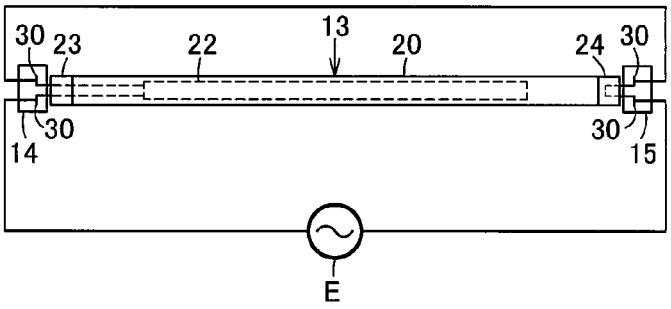
FIG. 4 is a circuit view showing an electrical wiring circuit of the lamp system.

Besides, FIG. 4 is a circuit view of an electrical wiring circuit of the lamp system 10. In the straight tube type lamp 13, the pair of lamp pins 30 of the cap 23 at one end side are connected to a pair of input terminals of the power circuit 22, and the pair of lamp pins 30 of the cap 24 at the other end side are shorted. AC power E is supplied to the one terminal 43 of each of the sockets 14 and 15 at both the ends, and the other terminals 43 of the sockets 14 and 15 at both the ends are electrically connected through an electric wire or the like. Incidentally, a fuse to open the circuit when an over current flows may be connected between the pair of lamp pins 30 of the cap 24 at the other end side.

Next, in the lamp system 10 configured as described above, when the straight tube type lamp 13 is mounted on the sockets 14 and 15 in a suitable combination of the straight tube type lamp 13 including the protrusion 31 and the sockets 14 and 15 including the recesses 63, after the pair of lamp pins 30 protruding from the caps 23 and 24 at both the ends of the straight tube type lamp 13 are inserted to the specified insertion position from the tip faces of the sockets 14 and 15, the lamp pins are rotated by 90° around the tube axis of the straight tube type lamp 13, so that the straight tube type lamp 13 can be mounted on the sockets 14 and 15 in an electric connection state.

When the straight tube type lamp 13 is inserted in the socket 14, 15, the lamp pin 30 is inserted from the insertion port 49 of the socket 14, 15 to the groove part 57 of the rotor 42 and the groove part 54*a* of the support part 54. At this time, the protrusion 31 moves in the recess 63 (the insertion port 49, the front region of the groove part 57 of the rotor 42) provided in the bracket face 44 of the socket 14, 15, and does not prevent insertion of the straight tube type lamp 13.

When the straight tube type lamp 13 is inserted to the specified insertion position of the socket 14, 15, the bent part 30*b* of the one lamp pin 30 first inserted from the insertion port 49 intrudes into the back side from the wall part 51 of the case 46, and the leg part 30*a* contacts the wall part 51. The pair of lamp pins 30 are arranged in the rotor 42, and the straight tube type lamp 13, together with the rotor 42, can be rotated with respect to the sockets 14 and 15.

When the straight tube type lamp 13 inserted to the specified insertion position with respect to the socket 14, 15 is rotated, the lamp is rotated by 90° around the tube axis of the straight tube type lamp 13, so that the light emission direction of the straight tube type lamp 13 is directed to the specified irradiation direction. By this, the pair of lamp pins 30 contact the rotor 42 at the outer diameter side with respective to the support part 54, and the rotor 42 rotates together with the straight tube type lamp 13. At this time, the protrusion 31 rotates and moves in the recess 63 of the front region of the support part 54 without interference with the support part 54, and does not prevent the rotation of the straight tube type lamp 13.

On the way of rotation of the straight tube type lamp 13, the leg parts 30*a* of the pair of lamp pins 30 are connected to the lamp pin connection parts 62 of the pair of terminals 43.

When the straight tube type lamp 13 is rotated to the specified mount position, the groove part 57 of the rotor 42 comes off the position of the insertion port 49 of the socket 14, 15 and is closed by the edge part of the opening 50. The pair of lamp pins 30 is prevented from falling off from the insertion port 49 of the socket 14, 15. Further, the bent parts 30*b* of the pair of lamp pins 30 are arranged at the back side of the terminals 43, and the lamp pins 30 are prevented from falling off from the socket 14, 15.

As shown in FIG. 4, in the state where the straight tube type lamp 13 is connected to the sockets 14 and 15, one pole side of the AC power E is connected to the power circuit 22 through the one lamp pin 30 from the socket 14 at the one end side, and the other pole side is connected to the power circuit 22 through the socket 15 at the other end side and the pair of shorted lamp pins 30 of the cap 24 at the other end side and through the other lamp pin 30 from the socket 14 at the one end side. By this, the AC power E is supplied to the power circuit 22 from the pair of lamp pins 30 of the cap 23 at the one end side. The power circuit 22 converts the AC power E into specified DC power and supplies to the light-emitting module 21, and the light-emitting element 26 is lit. The light from the lit light-emitting element 26 passes through the cover 20 and is irradiated to a specified irradiation direction below the luminaire 11.

Incidentally, when the cap 23 at the one end side of the straight tube type lamp 13 and the cap 24 at the other end side are oppositely mounted between the sockets 14 and 15, the AC power E is supplied to the power circuit 22 from the socket 15 at the other end side. Thus, the mount direction of the straight tube type lamp 13 is not limited, and the mounting workability of the straight tube type lamp 13 is excellent.

On the other hand, when the straight tube type lamp 13 is taken off, for example, the straight tube type lamp 13 is rotated by 90° in the direction opposite to that at the mounting time. By this, the groove part 57 of the rotor 42 rotated together with the pair of lamp pins 30 coincides with the insertion port 49 of the socket 14, 15, so that the pair of lamp pins 30 can be extracted through the insertion port 49 of the socket 14, 15. Also at this time, the protrusion 31 moves in the recess 63, and does not prevent the straight tube type lamp 13 from being taken off.

Besides, a description will be made on a case where the straight tube type lamp 13 including the protrusion 31 is mounted on an unsuitable socket not including the recess 63. Incidentally, in the description of the unsuitable socket not including the recess 63, reference numerals of components corresponding to those of the embodiment are put in parentheses.

In the straight tube type lamp 13, when the width size W2 of the protrusion 31 is wider than the width size W1 of the lamp pin 30, that is, when the width size W2 of the protrusion 31 is wider than the width size of the insertion port (49) of the unsuitable socket (14, 15), the protrusion 31 can not be inserted in the insertion port (49) of the unsuitable socket (14, 15). Thus, the straight tube type lamp 13 can not be inserted to the specified insertion position of the unsuitable socket (14, 15), and erroneous mounting of the straight tube type lamp 13 can be prevented.

Besides, in a straight tube type lamp (hereinafter referred to as an unsuitable straight tube type lamp) having a cap based on JEL801 and not including the protrusion 31, although a pair of L-shaped lamp pins are provided on the cap at one end side, one T-shape pin is protrudingly provided on the cap at the other end side. Thus, the cap shape is different, and the lamp can not be suitably mounted between the sockets 14 and 15 of the lamp system 10. Even if the pair of L-shaped lamp pins of the cap at the one end side of the unsuitable straight tube type lamp can be mounted on the socket 14 at the one end side, the AC power E is not supplied to the unsuitable straight tube type lamp and the erroneous mounting can be prevented, because in the lamp system 10, as shown in the electrical wiring circuit of FIG. 4, the electrical wiring circuit configuration is such that if the pair of lamp pins 30 of the cap 24 at the other end side of the straight tube type lamp 13 is not shorted, the circuit is not closed.

Further, the electrical wiring circuit configuration is such that if both ends of the straight tube type lamp 13 are not connected to the sockets 14 and 15, current does not flow. Accordingly, at the time of mounting of the straight tube type lamp 13, for example, when the cap 23 at one end side is mounted on the socket 14 and the lamp pin 30 is connected to the terminal 43, while the cap 24 at the other end side is not connected to the socket 15 and is inclined, even if an operator touches the lamp pin 30 of the cap 24, electric shock does not occur.

As stated above, in the lamp system 10, the protrusion 31 is protrudingly provided on the cap 23, 24 of the straight tube type lamp 13, and the socket 14, 15 is provided with the recess 63 in which the protrusion 31 is inserted and is rotated and moved with the insertion and rotation of the pair of lamp pins 30. Thus, the suitable straight tube type lamp 13 can be mounted on the sockets 14 and 15, and the straight tube type lamp 13 can be prevented from being erroneously mounted on the unsuitable socket not including the recess 63.

Besides, the protrusion 31 is arranged between the pair of lamp pins 30 on the end face of the cap 23, 24, so that the recess 63 can be provided in common with the insertion port 49 of the socket body 41 and the groove part 57 of the rotor 42. Thus, even if the recess 63 is provided, the socket 14, 15 can be prevented from being complicated. Further, the protrusion size H1 of the protrusion 31 from the end face of the cap 23, 24 can be easily increased, and even if there is an error in tube length of the straight tube type lamp 13, erroneous mounting on an unsuitable socket can be certainly prevented.

Further, since the width size W2 of the protrusion 31 is formed to be wider than the width size W1 of the pair of lamp pins 30, the straight tube type lamp 13 is restrained from being inserted in the insertion port (49) of the socket (14, 15) not including the recess 63, and erroneous mounting of the straight tube type lamp 13 can be prevented. Incidentally, in this case, the length size L in the longitudinal direction may be narrower than the width size W1 of the lamp pin 30.

Besides, the straight tube type lamp 13 incorporates the power circuit 22 to convert the AC power E and to supply to the light-emitting element 26, and the electrical wiring circuit is configured such that the pair of lamp pins 30 at one end side are respectively connected to the power circuit 22, the pair of lamp pins 30 at the other end side are shorted, the AC power E is supplied to the one terminal 43 of each of the sockets 14 and 15 at both the ends, and the other terminals 43 of the sockets 14 and 15 at both the ends are connected. Thus, even if an unsuitable straight tube type lamp is connected, power is not fed, and erroneous mounting of the unsuitable straight tube type lamp can be prevented.

Figure 6A:
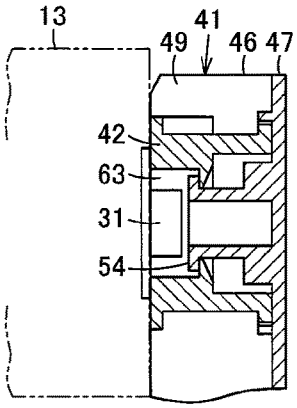
FIG. 6 shows a relation between a displacement of the straight tube type lamp in a lamp longitudinal direction and a socket according to temperature, in which FIG. 6(*a*) is a sectional view of a state where the straight tube type lamp is in a specified temperature range, FIG. 6(*b*) is a sectional view of a state where the straight tube type lamp is at a temperature higher than the specified temperature range, and FIG. 6(*c*) is a sectional view of a state where the straight tube type lamp is at a temperature lower than the specified temperature range.
Figure 6B:
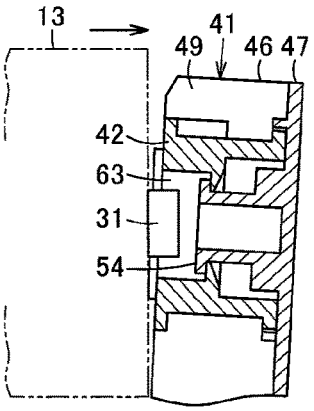
Figure 6C:
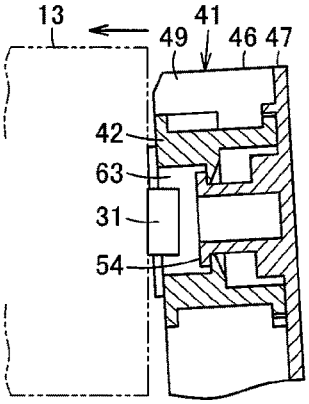

FIG. 6 shows a relation between a displacement in the lamp longitudinal direction and the socket 14, 15 according to temperature of the straight tube type lamp 13. When the straight tube type lamp 13 includes abase formed of an aluminum material, the temperature is changed by atmospheric temperature or heat generation in lighting. If the temperature changes in a range of 5° C. to 55° C. (temperature difference is 50° C.), a size change amount in the lamp longitudinal direction is estimated to be about 2 mm at most.

FIG. 6(*a*) shows a state of the straight tube type lamp 13 and the socket 14, 15 at an intermediate temperature in the temperature change range. In this state, the end face of the cap 23, 24 and the front face of the socket 14, 15 are substantially parallel to each other, and the protrusion 31 is arranged in the recess 63 of the rotor 42.

As shown in FIG. 6(*b*), when the temperature of the straight tube type lamp 13 rises from the intermediate temperature in the temperature change range, and the straight tube type lamp 13 extends in the lamp longitudinal direction, the sockets 14 and 15 at both ends are pushed and moved to the outside in the lamp longitudinal direction by the straight tube type lamp 13. That is, the tip side (rotor 42 side) of the socket body 41 separated from the equipment attachment part 48 side attached to the equipment body 12 swings to the outside in the lamp longitudinal direction by the elastic deformation of the socket body 41 itself (further including an attachment member of the equipment body 12 side to which the socket body 41 is attached). In this case, even if the front face of the socket 14, 15 is inclined with respect to the end face of the cap 23, 24, the protrusion 31 is arranged in the recess 63 of the rotor 42.

As shown in FIG. 6(*c*), even if the temperature of the straight tube type lamp 13 drops from the intermediate temperature in the temperature change range, and the straight tube type lamp 13 contracts in the lamp longitudinal direction, the protrusion 31 does not come off from the recess 63 of the rotor 42 and is arranged in the recess 63, because the size change amount in the lamp longitudinal direction of the straight tube type lamp 13 is about 2 mm at most, and the protrusion size H1 of the protrusion 31 is 3.5 mm. Incidentally, at the time of mounting of the straight tube type lamp 13 between the sockets 14 and 15, when the interval between the sockets 14 and 15 is narrower than the length size L of the straight tube type lamp 13, and the sockets 14 and 15 are elastically deformed to the outside in the lamp longitudinal direction by the mounted straight tube type lamp 13, the straight tube type lamp 13 contracts in the lamp longitudinal direction, and the tip sides (rotor 42 sides) of the sockets 14 and 15 at both ends swing to the inside in the lamp longitudinal direction. In this case, even if the front face of the socket 14, 15 is inclined with respect to the end face of the cap 23, 24, the protrusion 31 is arranged in the recess 63 of the rotor 42.

As stated above, in the lamp system 10 of the embodiment, even in the straight tube type lamp 13 in which the pair of lamp pins 30 whose tips protrude to the outside direction intersecting the lamp longitudinal direction are provided on the end faces of the caps 23 and 24 at both ends, since the sockets 14 and 15 can be moved in the lamp longitudinal direction, the expansion and contraction in the lamp longitudinal direction of the straight tube type lamp 13 can be dealt with.

Besides, since the tip side (rotor 42 side) of the socket body 41 separated from the equipment attachment part 48 side of the socket body 41 attached to the equipment body 12 can be moved in the lamp longitudinal direction by the elastic deformation of the socket body 41 itself, the expansion and contraction in the lamp longitudinal direction of the straight tube type lamp 13 can be dealt with by the simple configuration.

Incidentally, in the embodiment, the description is made on the case where the socket stand 35 is elastically deformed. However, when the sockets 14 and 15 are attached to the equipment body 12, the sockets 14 and 15 may be moved in the lamp longitudinal direction by the elastic deformation of the socket attachment part of the equipment body 12. Further, the sockets 14 and 15 and the socket stands 35 (or the socket attachment part of the equipment body 12) may be attached to be capable of relatively elastically sliding in the lamp longitudinal direction.

Besides, as shown in FIG. 6, even when the straight tube type lamp 13 is at any temperature, the protrusion 31 is arranged in the recess 63 of the rotor 42, that is, the protrusion 31 and the recess 63 of the rotor 42 overlap each other in the up-and-down direction. Thus, when the protrusion 31 contacts the inner face of the recess 63 of the rotor 42, the sockets 14 and 15 can receive and support the straight tube type lamp 13 through the protrusions 31. In this case, since the mechanical support of the straight tube type lamp 13 by the sockets 14 and 15 can be separated from the electrical connection between the lamp pin 30 and the terminal 43, the electrical connection between the lamp pin 30 and the terminal 43 can be stably performed.

Figure 7:
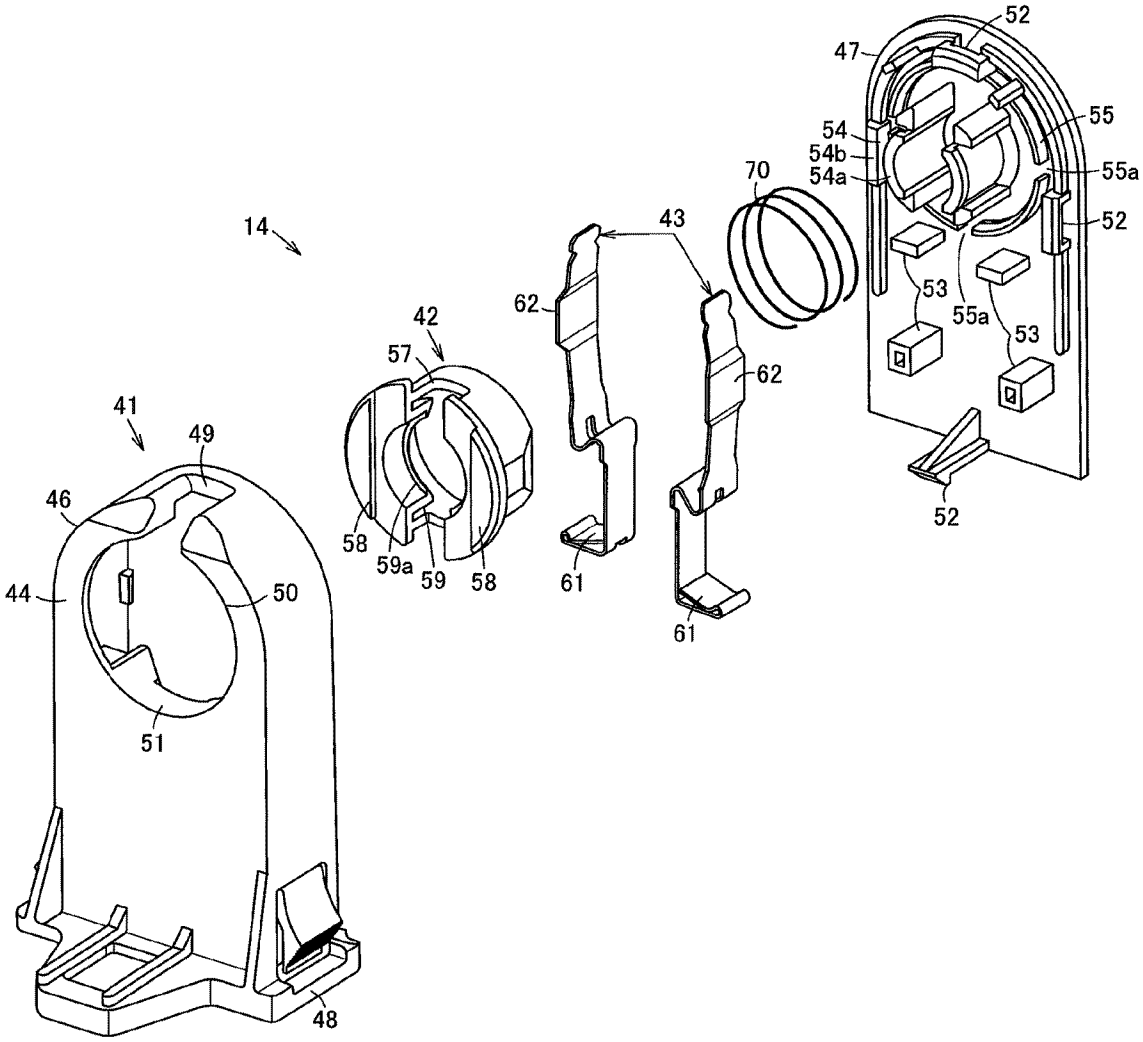
FIG. 7 is a perspective view of a disassembled state of a socket of a lamp system showing a second embodiment.
Figure 8:
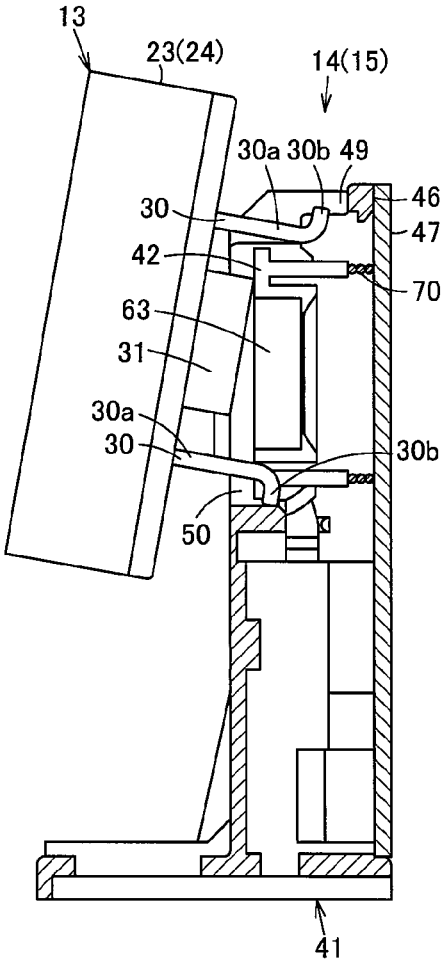
FIG. 8 is a sectional view for explaining an operation of the socket.

Next, FIG. 7 and FIG. 8 show a second embodiment. Incidentally, the same components and operations and effects as those of the first embodiment are denoted by the same reference numerals and the description thereof is omitted.

In this embodiment, a rotor 42 moves in a lamp longitudinal direction with respective to a socket body 41. That is, the length of the rotor 42 in the front-back direction (lamp longitudinal direction) is such a length that the rotor can move in the lamp longitudinal direction in the socket body 41, and a coil-shaped spring 70 as an urging unit is arranged between the rotor 42 and a cover 47. The rotor 42 is always urged to the front side of the socket body 41 by the spring 70.

The rotor 42 moves in the lamp longitudinal direction with respective to the socket body 41 correspondingly to the expansion and contraction in the lamp longitudinal direction of a straight tube type lamp 13, and the expansion and contraction in the lamp longitudinal direction of the straight tube type lamp 13 can be dealt with.

Besides, FIG. 8 shows a case where, when the straight tube type lamp 13 is mounted on the sockets 14 and 15, lamp pins 30 are inserted in a groove part 57 of the rotor 42 and the like from an oblique direction, and rotation positions of a protrusion 31 and the groove part 57 of the rotor 42 in a circumferential direction around a tube axis of the straight tube type lamp 13 are shifted from each other. In this case, the protrusion 31 is not inserted in the groove part 57 of the rotor 42 and interferes with the rotor 42. However, the rotor 42 moves to the depth side of the socket body 41 and is urged by the spring 70. Thus, the protrusion 31 is easily inserted in the groove part 57 of the rotor 42. Further, since the protrusion 31 is inserted in the groove part 57 of the rotor 42, the straight tube type lamp 13 can be inserted in the sockets 14 and 15 while the lamp pins 30 are guided to a suitable position of the groove part 57 of the rotor 42.

Figure 9:
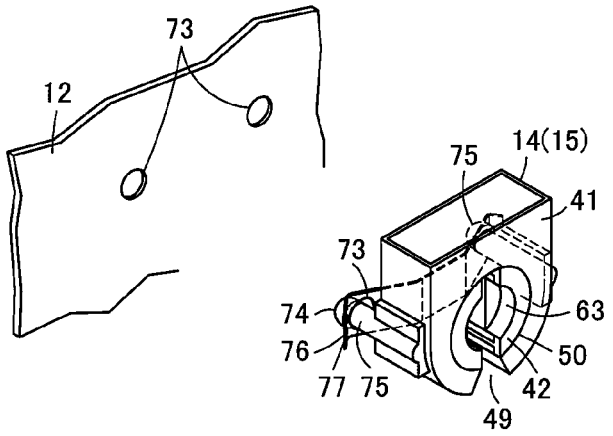
FIG. 9 is a perspective view of a socket of a lamp system showing a third embodiment.
Figure 10A:
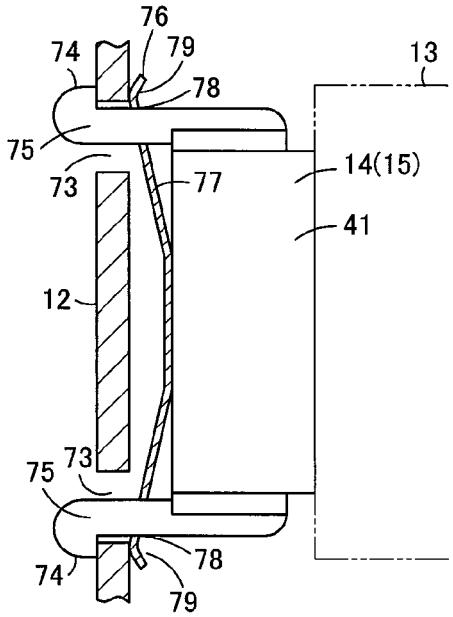
FIG. 10 shows a relation between a displacement of the straight tube type lamp in a lamp longitudinal direction and a socket according to temperature, in which FIG. 10(*a*) is a sectional view of a state where the straight tube type lamp is at a temperature higher than a specified temperature range, and FIG. 10(*b*) is a sectional view of a state where the straight tube type lamp is at a temperature lower than the specified temperature range.
Figure 10B:
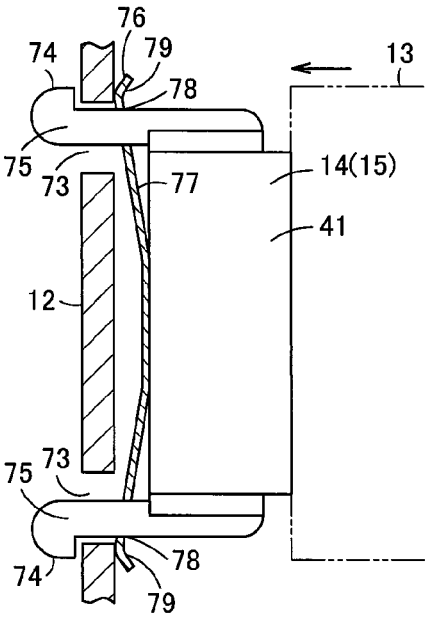
Figure 11:
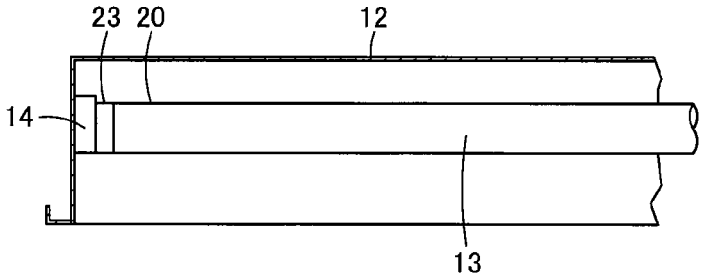
FIG. 11 is a sectional view of a luminaire of the lamp system.

Next, FIG. 9 to FIG. 11 show a third embodiment. Incidentally, the same components and operations and effects as those of the respective embodiments are denoted by the same reference numerals and the description thereof is omitted.

Sockets 14 and 15 are circular sockets, and are attached by using a pair of attachment holes 73 provided in end plates at both ends of an equipment body 12.

Similarly to the foregoing respective embodiments, the socket 14, 15 is of a rotation mounting type in which the socket is mounted by rotation of 90° around a tube axis of a straight tube type lamp 13, and includes a socket body 41, a rotor 42 arranged in the socket body 41, and a pair of terminals 43 (not shown).

A pair of locking pawls 75 including pawl parts 74 at tips are provided on both sides of the socket body 41 to protrude from the back face of the socket body 41. An interval between the pair of pawl parts 74 is wider than an interval between the pair of attachment holes 73. The socket body 41 is attached to the equipment body 12 to be capable of moving in the lamp longitudinal direction.

A plate spring 77 as a support unit 76 to urge the socket body 41 in a direction of separating from the end plate of the equipment body 12 is attached to the back face of the socket body 41. The plate spring 77 is bent so that an intermediate part protrudes to the back side of the socket body 41, and both ends are separated from the back face of the socket body 41. At both ends of the plate spring 77, insertion holes 78 through which the locking pawls 75 pass are formed, and contact parts 79 which are bent to have substantially L-shaped sections and contact the end plate of the equipment body 12 are formed.

As shown in FIG. 10(*a*), for example, when the straight tube type lamp 13 is at an intermediate temperature in a temperature change range, the sockets 14 and 15 are moved to the straight tube type lamp 13 by urging of the plate spring 77, and the pawl parts 74 are caught by the end plate of the equipment body 12, so that the movement is regulated.

Besides, as shown in FIG. 10(*b*), when the temperature of the straight tube type lamp 13 rises, and the straight tube type lamp 13 extends in the lamp longitudinal direction, the sockets 14 and 15 at both ends are pushed to the outside in the lamp longitudinal direction by the straight tube type lamp 13, and the plate spring 77 contracts, so that the sockets 14 and 15 move to the outside in the lamp longitudinal direction.

Besides, even if the temperature of the straight tube type lamp 13 drops, and the straight tube type lamp 13 contracts in the lamp longitudinal direction, a protrusion 31 of the straight tube type lamp 13 does not come off from a recess 63 of the rotor 42 and is arranged in the recess 63.

As stated above, also in the lamp system 10 using the circular sockets 14 and 15, the sockets 14 and 15 themselves move in the lamp longitudinal direction, so that the expansion and contraction in the lamp longitudinal direction of the straight tube type lamp 13 can be dealt with.

Figure 12:
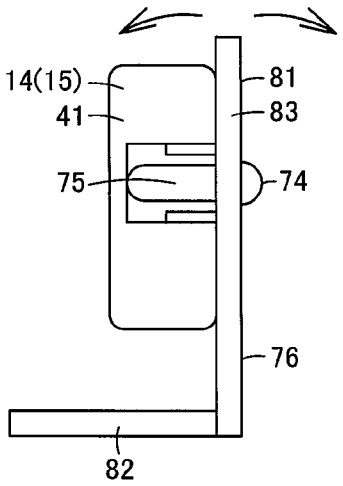
FIG. 12 is a side view of a socket of a lamp system showing a fourth embodiment.

Next, FIG. 12 shows a fourth embodiment. Incidentally, the same components and operations and effects as those of the respective embodiments are denoted by the same reference numerals and the description thereof is omitted.

Circular sockets 14 and 15 are used, and the sockets 14 and 15 are attached to an equipment body 12 by using a metal fitting 81 as a support unit 76. The metal fitting 81 is formed to have an L-shaped section including an equipment attachment plate part 82 to be attached to the equipment body 12 and a socket attachment plate part 83 to which the socket 14, 15 is attached. In the metal fitting 81, the socket attachment plate part 83 can be elastically deformed in the lamp longitudinal direction with respective to the equipment attachment plate part 82.

As stated above, the sockets 14 and 15 themselves move in the lamp longitudinal direction, so that the expansion and contraction in the lamp longitudinal direction of the straight tube type lamp 13 can be dealt with.

Incidentally, the support unit 76 may support so that the sockets 14 and 15 slide along the lamp longitudinal direction with respective to the equipment body 12 side.

Figure 13:
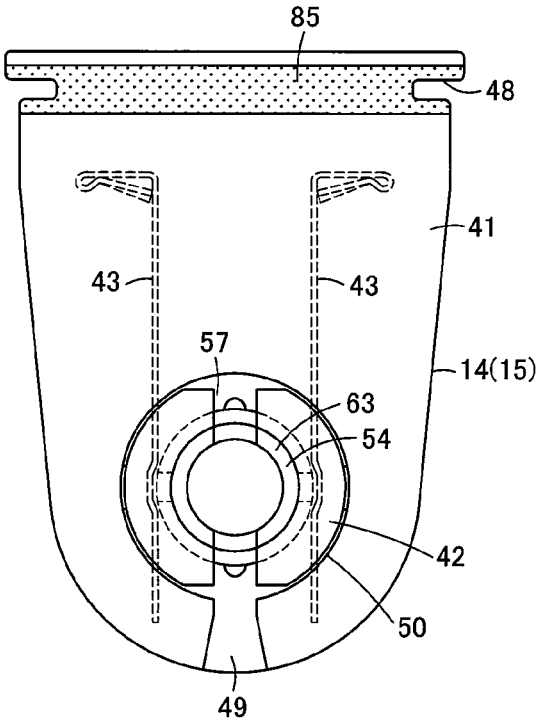
FIG. 13 is a front view of a socket of a lamp system showing a fifth embodiment.
Figure 14:
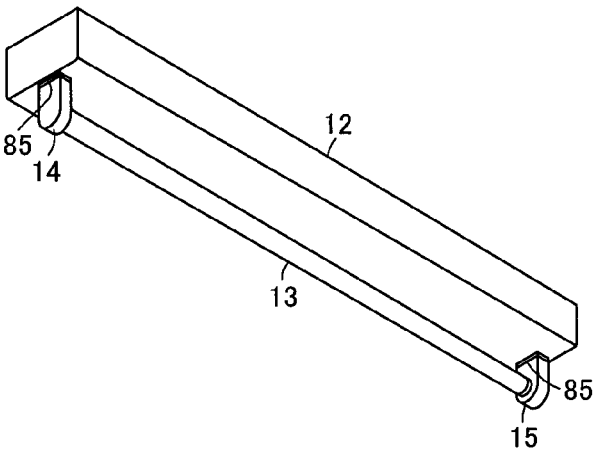
FIG. 14 is a perspective view of a luminaire of the lamp system.
Figure 15:
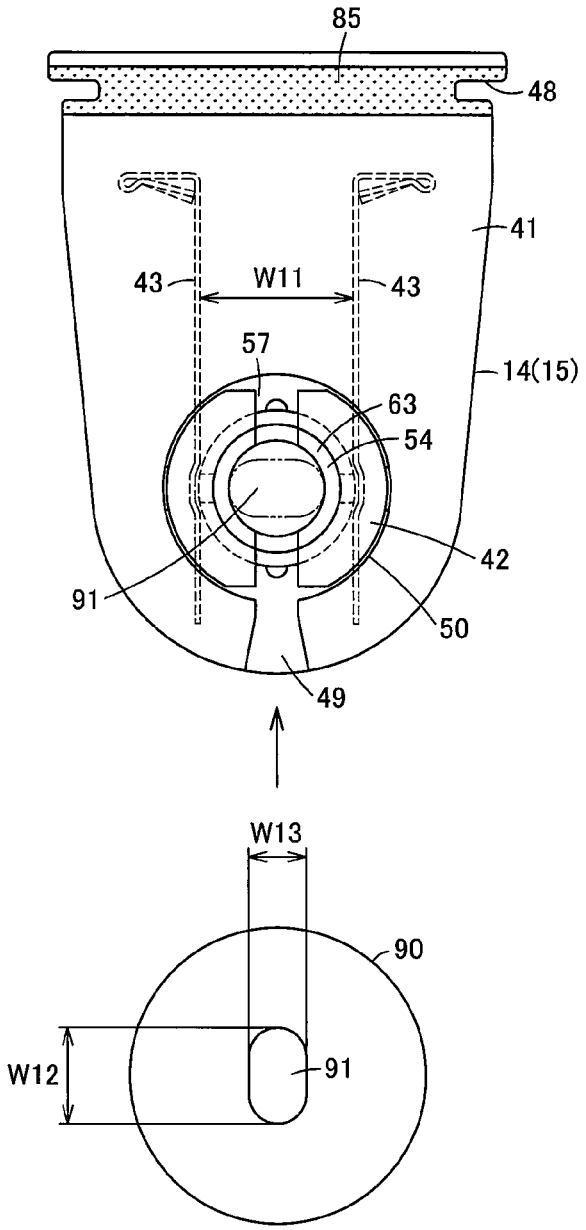
FIG. 15 is a front view for explaining an operation of the socket.

Next, FIG. 13 to FIG. 15 show a fifth embodiment. Incidentally, the same components and operations and effects as those of the respective embodiments are denoted by the same reference numerals and the description thereof is omitted.

Similarly to the first embodiment, a socket 14, 15 has a configuration including a socket body 41 provided with an equipment attachment part 48. A cover 85 having flexibility, such as silicone rubber, as a support unit 76 is arranged on the equipment attachment part 48, and the equipment attachment part 48 is attached to an equipment body 12 side through the cover 85.

By this configuration, the socket 14, 15 can move in a lamp axis direction through the cover 85, and expansion and contraction in a lamp longitudinal direction of a straight tube type lamp 13 can be dealt with.

Besides, as shown in FIG. 15, an interval W11 between a pair of terminals 43 is wider than a width of a non-feeding side pin 91 as a T-shaped pin of a straight tube type lamp 90 including a cap based on JEL801. For example, the interval W11 between the pair of terminals 43 is 9 mm, a width W12 in a long length direction of the non-feeding side pin 91 is 8.0 to 8.4 mm, and a width W13 in a short length direction is 4.6 to 5.0 mm.

By this size relation, even if the non-feeding side pin 91 is forcibly inserted in a rotor 42 of the socket 14 at feeding side and is rotated by 90°, the pair of terminals 43 are not shorted, and AC power is not fed to the straight tube type lamp through the non-feeding side pin 91.

Incidentally, although both the sockets 14 and 15 at both ends may be made to be capable of moving in the lamp longitudinal direction, if at least one is made to be capable of moving in the lamp longitudinal direction, the foregoing operations and effects are obtained.

Besides, the shape of the protrusion 31 is not limited to the square as in the foregoing embodiment, and may be a polygon. Even if the protrusion 31 has any shape, when the straight tube type lamp 13 provided with the protrusion 31 is mounted on an unsuitable socket not including the recess 63, the erroneous insertion can be prevented, and even if the lamp is erroneously inserted, the rotation can be prevented, and further, falling off from the socket 14, 15 at the time of contraction in the lamp longitudinal direction of the straight tube type lamp 13 can be prevented.

Besides, since the width size W2 of the protrusion 31 is larger than the width size W1 of the lamp pin 30, when the straight tube type lamp 13 including the protrusion 31 is mounted on an unsuitable socket not including the recess 63, the erroneous insertion can be certainly prevented.

Besides, since the protrusion size H1 of the protrusion 31 is lower than the height of the lamp pin 30, and is preferably ⅓ to ⅔ of the height of the lamp pin 30, the design of the socket 14, 15 can be facilitated.

Besides, although the protrusion 31 may be provided at both ends in the lamp longitudinal direction of the straight tube type lamp 13, even if the protrusion is provided only at one end, the foregoing operations and effects can be obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

10 lamp system
13 straight tube type lamp
14, 15 socket
20 cover
23, 24 cap
26 light-emitting element
30 lamp pin
31 protrusion
41 socket body
42 rotor as mount part
43 terminal
48 equipment attachment part
50 opening as arrangement part
57 groove part
76 support unit

The invention claimed is:

1. A lamp system comprising:

a straight tube type lamp including a straight tube type cover containing a light-emitting element, caps arranged at both ends of the cover, and a pair of lamp pins which are protrudingly provided on end faces of the caps at both the ends and whose tips respectively protrude in directions intersecting a lamp longitudinal direction; and a socket including a socket body, a mount part which is arranged in the socket body and on which the pair of lamp pins of the straight tube type lamp are mounted, and a pair of terminals to which the pair of lamp pins mounted on the mount part are connected, in which at least the mount part can move in the lamp longitudinal direction, wherein a protrusion is protrudingly provided between the pair of lamp pins on the end faces of the caps of the straight tube type lamp, and the mount part includes a groove part in which the pair of lamp pins and the protrusion are inserted, and can rotate together with the inserted pair of lamp pins and the protrusion with respect to the socket body.

2. The system according to claim 1, wherein the socket can support the straight tube type lamp through the protrusion.

3. A lamp system comprising:

a straight tube type lamp including a straight tube type cover containing a light-emitting element, caps arranged at both ends of the cover, and a pair of lamp pins which are protrudingly provided on end faces of the caps at both the ends and whose tips respectively protrude in directions intersecting a lamp longitudinal direction; and a socket including a socket body, a mount part which is arranged in the socket body and on which the pair of lamp pins of the straight tube type lamp are mounted, and a pair of terminals to which the pair of lamp pins mounted on the mount part are connected, in which at least the mount part can move in the lamp longitudinal direction, wherein the socket body includes an arrangement part where the mount part is arranged, and an equipment attachment part at a position separated from the arrangement part, and an arrangement part side can be elastically deformed in the lamp longitudinal direction with respective to an equipment attachment part side, a protrusion is protrudingly provided between the pair of lamp pins on the end faces of the caps of the straight tube type lamp, and the mount part includes a groove part in which the pair of lamp pins and the protrusion are inserted, and can rotate together with the inserted pair of lamp pins and the protrusion with respect to the socket body.

4. The system according to claim 3, wherein the socket can support the straight tube type lamp through the protrusion.

5. A lamp system comprising:

a straight tube type lamp including a straight tube type cover containing a light-emitting element, caps arranged at both ends of the cover, and a pair of lamp pins which are protrudingly provided on end faces of the caps at both the ends and whose tips respectively protrude in directions intersecting a lamp longitudinal direction;

a socket including a socket body, a mount part which is arranged in the socket body and on which the pair of lamp pins of the straight tube type lamp are mounted, and a pair of terminals to which the pair of lamp pins mounted on the mount part are connected, in which at least the mount part can move in the lamp longitudinal direction; and a support unit to support the socket to be movable in the lamp longitudinal direction, wherein a protrusion is protrudingly provided between the pair of lamp pins on the end faces of the caps of the straight tube type lamp, and the mount part includes a groove part in which the pair of lamp pins and the protrusion are inserted, and can rotate together with the inserted pair of lamp pins and the protrusion with respect to the socket body.

6. The system according to claim 5, wherein the socket can support the straight tube type lamp through the protrusion.

* * * * *